United States Patent [19]

Mishina et al.

[11] Patent Number: 4,587,941

[45] Date of Patent: May 13, 1986

[54] INTAKE BURNER

[75] Inventors: Hidetoshi Mishina, Tokyo; Hiroshi Takahashi; Hisatsugu Iizuka, both of Kanagawa; Noriyoshi Nakanishi, Kagoshima; Noriaki Tateno, Kagoshima; Shigetoshi Toeda, Kagoshima, all of Japan

[73] Assignees: Isuzu Motors Limited; Kyocera Corp., both of Tokyo, Japan

[21] Appl. No.: 537,640

[22] Filed: Sep. 30, 1983

[30] Foreign Application Priority Data

| | | | |
|---|---|---|---|
| Sep. 30, 1982 | [JP] | Japan | 57-147048[U] |
| Sep. 30, 1982 | [JP] | Japan | 57-147049[U] |
| Sep. 30, 1982 | [JP] | Japan | 57-147050[U] |
| Sep. 30, 1982 | [JP] | Japan | 57-147051[U] |
| Sep. 30, 1982 | [JP] | Japan | 57-147052[U] |
| Sep. 30, 1982 | [JP] | Japan | 57-147053[U] |
| Oct. 30, 1982 | [JP] | Japan | 57-165656[U] |

[51] Int. Cl.[4] ..... F02M 31/00

[52] U.S. Cl. ..... 123/550; 123/551; 123/145 A; 123/179 H

[58] Field of Search ..... 123/550, 551; 432/222; 219/205; 261/142; 219/206, 207, 273, 275, 270

[56] References Cited

U.S. PATENT DOCUMENTS

| | | | |
|---|---|---|---|
| 2,030,937 | 2/1936 | Reichmann | 123/145 A |
| 2,672,546 | 3/1954 | Klingner | 123/145 A |
| 3,158,787 | 11/1964 | Testerini | 123/145 A |
| 3,407,794 | 10/1968 | Nagai | 123/145 A |
| 3,566,850 | 3/1971 | Beesch | 123/179 H |
| 4,112,577 | 9/1978 | Mann | 123/145 A |
| 4,358,663 | 11/1982 | Sperner | 123/145 A |
| 4,401,065 | 8/1983 | Minegishi et al. | 123/145 A |
| 4,458,637 | 7/1984 | Minegishi et al. | 123/145 A |

FOREIGN PATENT DOCUMENTS

| | | | |
|---|---|---|---|
| 2142925 | 8/1971 | Fed. Rep. of Germany | 123/145 A |

*Primary Examiner*—Ronald H. Lazarus

*Attorney, Agent, or Firm*—John R. Benefiel

[57] ABSTRACT

An intake burner is disclosed for use in an internal combustion engine having an air intake system including an air intake tube, comprising an outer tube adapted to be attached to the air intake tube, a heater mounted in the outer tube and made of a ceramic material with a heating resistor embedded therein. A holder surrounds the heater in spaced relation thereto and together with the heater defines a vaporizing and a combustion region around the heater for vaporizing supplied fuel along a surface of the heater and for burning vaporized fuel supplied from the vaporizing region. Fuel feed means directs fuel into the vaporizing region around the heater, and a support member attaches the heater to the outer tube.

27 Claims, 33 Drawing Figures

FIG.5
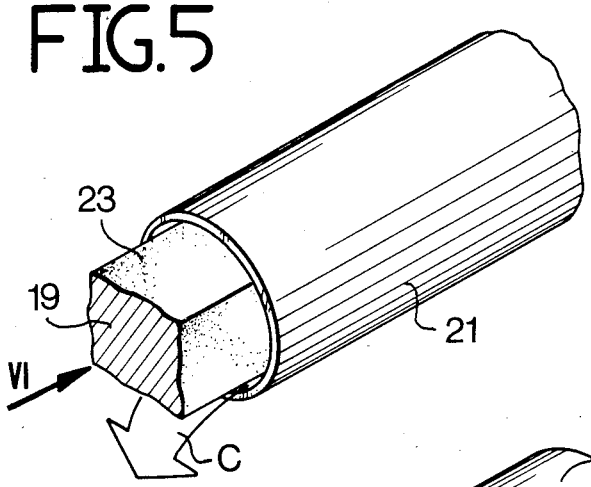
FIG.6
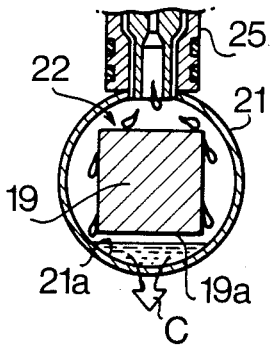
FIG.7
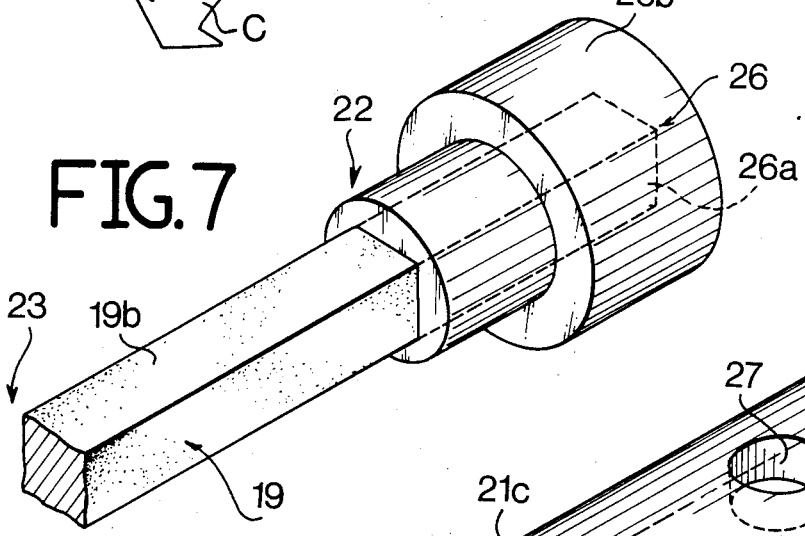
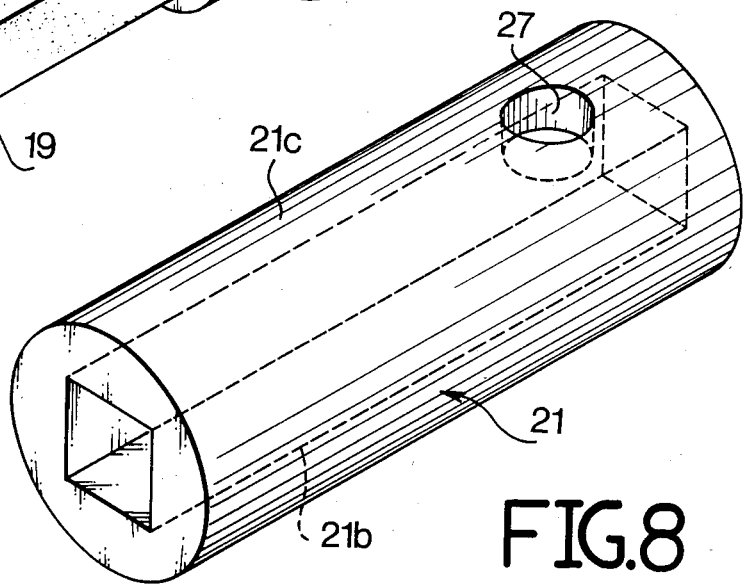
FIG.8

FIG.26
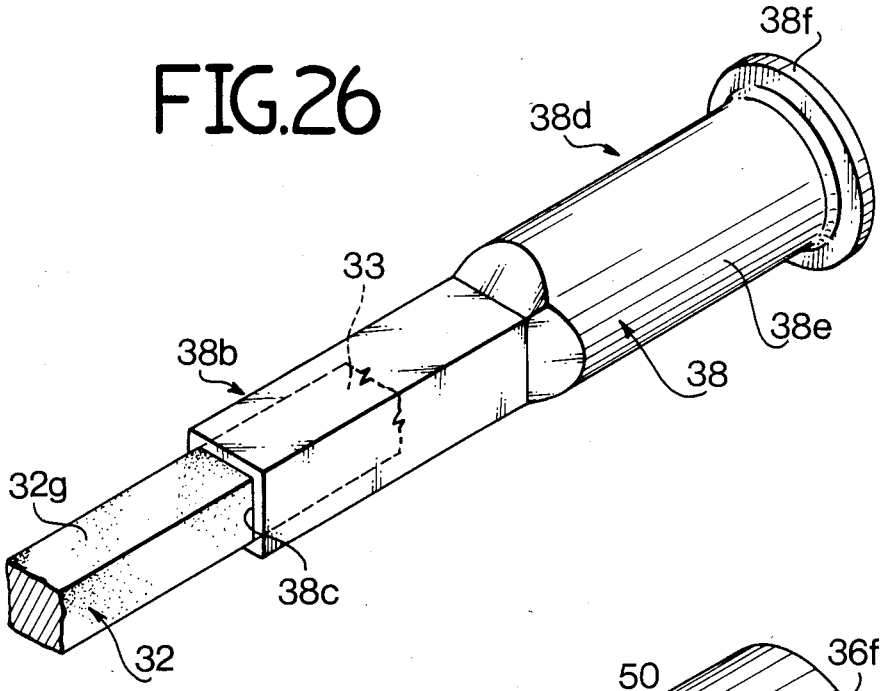
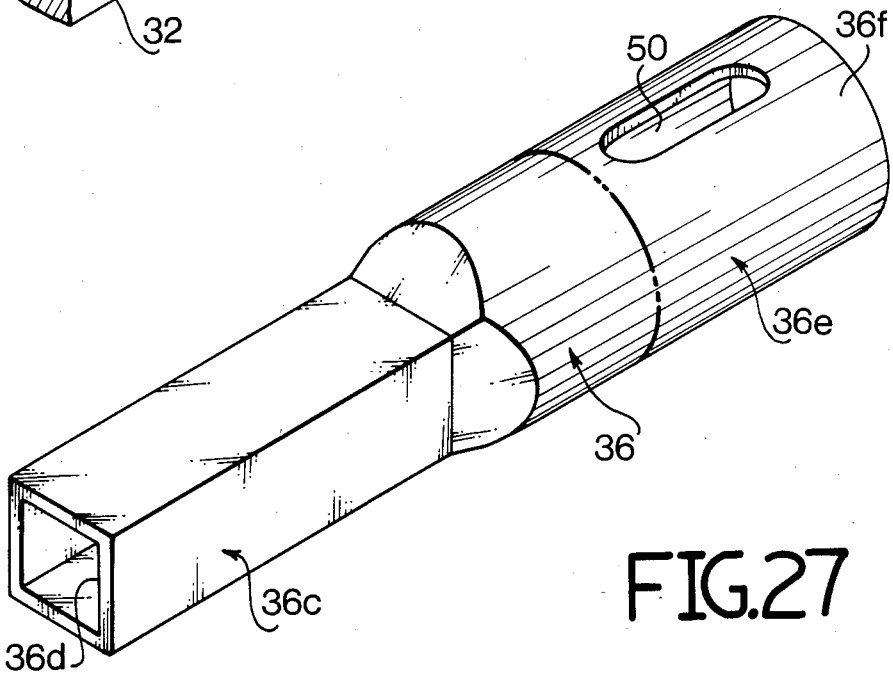
FIG.27

INTAKE BURNER

BACKGROUND OF THE INVENTION

1. Field of the Invention

The present invention relates generally to an intake burner for use in internal combustion engines, such as diesel engines, for heating intake air flowing through an air intake system to enable the engine to start more smoothly and reliably. More particularly, the invention relates to an intake burner having an electric heater made of a ceramic material and having a heating resistor embedded therein.

2. Description of the Relevant Art

Internal combustion engines, particularly diesel engines, fail to start smoothly under low temperature conditions since the fuel may not be ignited when low temperature air is compressed in the engine cylinders.

To solve this problem, internal combustion engines have been equipped with air intake systems utilizing an intake burner. This is shown in FIG. 1 of the accompanying drawings in which the engine 1 has an air intake system 2 provided with an intake burner 3 which heats intake air flowing through the air intake system 2 by the burning of fuel in the intake air. This thereby improves the ability of the engine 1 to start smoothly and reliably under low air temperature conditions.

FIGS. 2 and 3 illustrate different types of known intake burners. The intake burner 3*a* in FIG. 2 is mounted on an intake pipe 4 and has a burner end 5 extending into an air intake system 2 for heating intake air flowing therein by burning supplied fuel. The intake burner 3*a* comprises a fuel feed tube 6 for feeding fuel supplied from a fuel pump (not shown) to the burner end 5, and a heating resistor 7 disposed around the fuel feed tube 6 for heating the fuel. The heating resistor 7 comprises a Nichrome wire coil that can be raised to a red heat on application of a voltage from a power supply (not shown). The fuel flowing from an inlet 6*a* of the fuel feed tube 6 is metered by an orifice 6*b* in passing through the fuel feed tube 6, and is then vaporized by being heated by the heating resistor 7. The vaporized fuel passes into the burner end 5 where the fuel vapor is ignited by further heating action of the heating resistor 7. Combustion of the fuel in the air intake system 2 thus heats air supplied into the engine 1.

The intake burner 3*a* shown in FIG. 2 has, however, suffered from the following problems:

(1) The heating resistor 7 comprises a Nichrome wire which is exposed for effective thermal radiation, and if a high voltage is applied to the heating resistor 7 to heat the latter to a red heat in order to start the engine 1 in a reduced period of time, the heating resistor 7 tends to be oxidized or corroded by sulfur oxides produced by combustion of sulfur in the fuel. The heating resistor 7 is thus liable to be broken and less durable in service. To avoid this, the heating resistor 7 has to be heated slowly, and the engine 1 therefor cannot be started quickly.

(2) The heating resistor 7 is directly exposed to low temperature intake air, and when the engine 1 is started by energizing a starting motor, the heating resistor 7 is cooled by the increased flow of intake air and may fail to burn the fuel, thus failing to start the engine 1 smoothly.

The intake burner shown in FIG. 3 is generally denoted at 3*b* and has an outer tube 8 serving as an outer casing attached to and extending into an air intake tube 4 and a heater 12 comprising a metal sheath 9 housing a heating resistor 10 in the form of a Nichrome wire coil. The sheath 9 also contains a volume of powder 11 such as magnesium oxide packed for increased thermal capacity. The heater 12 is heated upon energizing the heating resistor 10 by the application of a power supply voltage through a terminal 13 at an outer end of the outer tube 8.

The intake burner 3*b* also has a fuel feed nozzle 14 disposed outside of the air intake system 2 and connected to a fuel pump (not shown), the fuel feed nozzle 14 communicating with a vaporizing region 15. Fuel as fed from the fuel feed nozzle 14 is heated and vaporized in the vaporizing region 15, and the vaporized fuel is fed along an outer peripheral surface of the heater 12 in the longitudinal direction thereof. The intake burner 3*b* has a combustion region 16 extending into the air intake system 2 for additionally heating and burning of the vaporized fuel fed from the vaporizing region 15, to thereby heat the intake air. A tubular holder 17 is disposed in the outer tube 8 and surrounds the outer peripheral surface of the heater 12 longitudinally therealong. The holder 17 serves to fill the space between itself and the heater 12 with the fuel continuously supplied from the fuel feed nozzle 14 and to feed the fuel from the vaporizing region 15 to the combustion region 16 for promoting the vaporization of the fuel. A tubular sleeve 18 prevents flames of the burned fuel from being blown out by a high rate of flow of intake air.

The intake burner 3*b* as shown in FIG. 3 has also had shortcomings, as follows:

(1) The metal sheath 9 is heated indirectly by the heating resistor 10 through the volume of magnesium oxide powder 11, insulating the heating resistor 10 from the atmosphere. This construction requires a longer time to heat the heater 12, and hence cannot achieve a reduction in the time for starting the engine 1.

(2) Since the volume of powder 11 as of magnesium oxide is packed in the metal sheath 9, the coils of the heating resistor 10 may be mispositioned and may sometimes be short-circuited. This structural difficulty results in a failure to achieve adequate temperature control, and a desired temperature distribution cannot be accomplished over the zone from the vaporizing region 15 to the combustion region 16. Excessive combustion which may result from the foregoing shortcoming consumes too much oxygen in the air intake system 2 which then becomes short of oxygen. On the other hand, the heater 12 cannot be sufficiently heated as a whole, with the result that the fuel will not be ignited smoothly or the flames will die out. Accordingly, a smooth engine starting capability cannot be achieved.

With the foregoing problems of the prior art in view, the inventors have directed their attention to a ceramic material for use as an intake burner heater material due to its good heat, oxidation, and corrosion resistance. The inventors have found that the problems with the prior art intake burners can be solved by forming an entire heater 19 (shown in FIG. 4 of the accompanying drawings) of a ceramic material into a rod shape and embedding a heating resistor 20 such as a tungsten wire in the heater 19, the heater 19 being supported by a holder 21.

It is however necessary to take into account the following considerations in constructing such an intake burner:

(1) When fuel is supplied from a fuel feed nozzle (not shown), the vaporizing region 22 between the holder 21 and the heater 19 is cooled, and the resistance of the heating resistor 20 in the vaporizing region 22 is reduced due to the resulting temperature drop. Thus, only a partial voltage drop takes place along the heating resistor 20 in the vaporizing region 22. Although the combustion region 23 around the heater 19 extends out of the holder 21 and is therefore subjected to a low temperature air flow, the heating resistor 20 has applied to it an increased voltage due to the reduced voltage drop in the vaporizing region 22, and thus generates increased heat.

Where the heating resistor 20 is constructed with coils of equal pitch, the surface temperature T of the heater 19 is substantially uniform before fuel is supplied throughout the length of the heater 19, that is, from the vaporizing region 22 to the combustion region 23. This is shown by the dot-and-dash line A in FIG. 4. When fuel is fed into the vaporizing region 22, the latter is excessively cooled and fails to vaporize the fuel smoothly. At the same time, the heating resistor 20 in the combustion region 23 is unduly heated to a surface temperature higher than an allowable maximum temperature Tmax (shown by the solid line B) for the ceramic material of the heater 19. The heater 19 is then liable to get cracked due to the excessive heat or the heating resistor 20 tends to be broken.

Also designated in FIG. 4 is $T_F$, the lowest surface temperature producing fuel ignition and $T_L$, the lowest surface temperature producing proper fuel vaporization. If the voltage applied by a power supply 24 is lowered to eliminate the above shortcoming, then all of the surface temperatures T of the heater 19 would be lowered correspondingly, and the heater 19 in the vaporizing region 22 could be lowered to a temperature below $T_L$, a temperature at which it would fail to vaporize the fuel. Similarly, any vaporized fuel might not be ignited due to the exposure of the combuation region 23 to flowing intake air, and resultant cooling of the heater 19 in that region below $T_F$.

(2) Due to limitations (described later) on the shape of the heater 19, the heater 19 is substantially rectangular, preferably square, in cross section, with a large clearance space between the heater 19 and the holder 21 resulting from the cylindrical shape of the holder 21, as shown in FIGS. 5 and 6 of the accompanying drawings. When fuel is supplied from a fuel feed nozzle 25 onto the outer surface of the heater 19, the fuel does not at once fill the holder 21 during start up, and this results in substantially no fuel applied to a lower surface **19*a* of the heater 19 remote from the fuel feed nozzle 25. During start up, therefore, the lower heater surface 19*a* does not contribute to fuel vaporization. Since the lower heater surface 19*a* is widely spaced from an inner holder wall 21*a* below the heater 19, a pool of fuel is formed therebetween which will not be heated but will flow out from between the heater 19 and the holder 21** in the direction of the arrow C.

As a consequence, the fuel cannot be vaporized smoothly in the vaporizing region 22 surrounded by the holder 21 even if the heater performance is good, and also the fuel cannot be ignited instantaneously and reliably in the combustion region 23. It is desirable to eliminate the above problem for stable fuel combustion.

Another difficulty is that any unvaporized fuel is likely to flow out of an outer tube into the air intake tube 4 and be trapped therein, thereby damaging the air intake system 2.

(3) Where the holder 21 is shaped complementarily to the heater 19 to avoid the problem mentioned above in (2), the following problems must be solved: As shown in FIG. 7 of the accompanying drawings, a support member 26 of metal for attaching the heater 19 to the outer tube (not shown) is mounted on the heater 19 adjacent to the vaporizing region 22. The support member 26 has a hole **26*a* of a rectangular cross section (which may be square as shown), in which the heater 19 is fitted, and an outer cylindrical surface 26*b* adapted to be within a bore formed in the outer tube (not shown). The support member 26** is of a stepped configuration so as to be pushed and held in position by a bolt threaded in an end of the outer tube, as will be described.

As illustrated in FIG. 8, the holder 21 is formed so that the heater 19 may be covered by the holder 21 between the vaporizing region 22 and the combustion region 23 for promoting fuel vaporization. For this purpose, holder 21 has an inner surface **21*b* of a rectangular cross section spaced an equal distance from an outer peripheral surface 19*b* of the heater 19. The holder 21 also has an outer cylindrical surface 21*c* adapted to be fitted within a bore of the outer tube (not shown). The holder 21 has a fuel inlet 27 through which fuel is introduced from the fuel feed nozzle 25**.

The holder 21 and the support member 26 have their inner surfaces **21*b*, 26*a* of a rectangular cross section (which may be square as shown) and their outer surfaces 21*c*, 26*b* of a cylindrical shape due to limitations on the configuration of the heater 19 and the ease of machining of the outer tube. Its inner cylindrical surface can also easily be machined by known techniques. Such holder 21 and support member 26 can be fabricated by machining a solid cylindrical body or a thick tubular member through discharge machining to the shape as shown in FIGS. 7 and 8**. However, this type of machining process is highly complex and could not be relied upon for mass production. Furthermore, machined products would be too thick, result in an increased material cost, and increase their weight.

SUMMARY OF THE INVENTION

It is an object of the present invention to provide an intake burner having a simple construction composed of a heater made of a ceramic material and a heating resistor embedded in the heater, the intake burner being highly durable in operation, capable of being heated rapidly within a reduced period of time for reliable fuel ignition, and of maintaining stable combustion of fuel for improved engine starting capability.

Another object of the present invention is to provide an intake burner having a heater constructed so that the resistance distribution of a heating resistor and thereby the temperature distribution of the heater can freely be determined and controlled for proper heater temperature control.

Still another object of the present invention is to provide an intake burner including a heater having different outer profiles, that is, varied heat radiation surface areas or thermal capacities in the vaporizing and combustion regions so that a prescribed temperature distribution of these surfaces can be maintained when it is cooled by fuel supply and intake air flow.

Still another object of the present invention is to provide an intake burner in which fuel fed into the burner during start up can be effectively vaporized before the holder is filled to enable the heater to ignite fuel instantaneously and reliably.

A still further object of the present invention is to provide an intake burner which can be economically manufactured at a high rate of production.

According to the present invention, there is provided an intake burner for use in an internal combustion engine havinq an air intake system including an air intake tube, the intake burner comprising an outer tube adapted to be attached to the air intake tube, a heater mounted in the outer tube and made of a rod of ceramic material with a heating resistor embedded therein. The outer surface of the ceramic rod is exposed within the outer tube and includes a portion defining in part a vaporizing region for vaporizing supplied fuel along a part of the surface of the heater and a combustion region defined in part by another part of the heater surface for burning vaporized fuel supplied from the vaporizing region. A holder surrounds the heater in spaced relation thereto, together with the heater and defines the vaporizing and combustion regions around the heater. Fuel feed means is also included for feeding fuel into the vaporizing region around the heater, and a support member attaches the heater to the outer tube. The heater has a rectangular, preferably square, cross section throughout the length thereof, the holder comprising a cylindrical tubular configuration extending longitudinally thereof, the heater having a corner located closely to and spaced from an inner bottom wall of the holder. Alternatively, the heater may have a square cross section throughout a length thereof, the holder surrounding the heater with a substantially equal distance left between an inside surface of the holder and the outside surface of the heater.

In one embodiment, the heating resistor includes a first heating resistor for heating the heater along its entire length, and a second heating resistor for heating a boundary region between the combustion and vaporizing regions to promote ignition of the vaporized fuel.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 5 is a perspective view of the portion of the burner shown in FIG. 4 encircled with R;

FIG. 6 is a cross-sectional view taken along line VI—VI of FIG. 5;

FIG. 7 is a perspective view of a support member used with the burner heater;

FIG. 8 is a perspective view of a holder used with the burner heater;

FIG. 26 is a perspective view of a support member according to a ninth embodiment;

FIG. 27 is a perspective view of a holder according to the ninth embodiment;

DESCRIPTION OF THE PREFERRED EMBODIMENTS

Preferred embodiments of the present invention will now be described with reference to the accompanying drawings.

Figure 1:
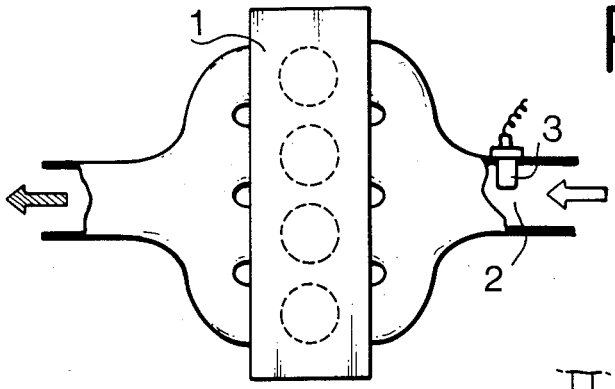
FIG. 1 is a schematic plan view of an air intake system for an internal combustion engine.
Figure 2:
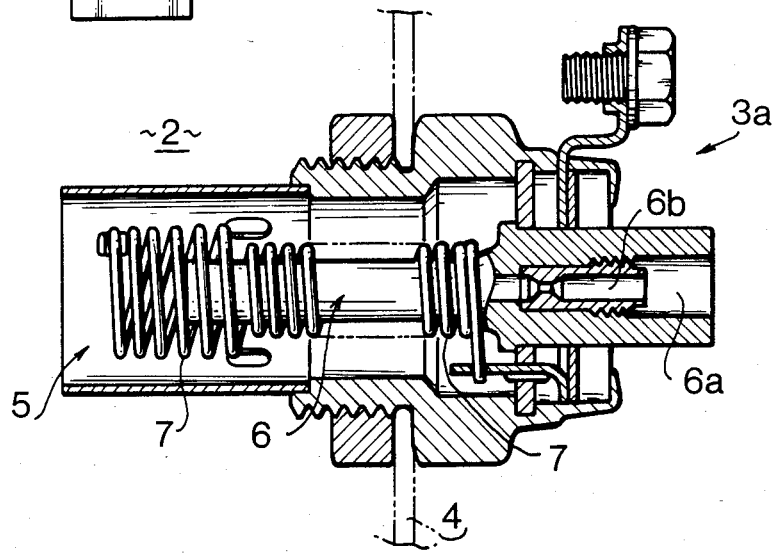
FIGS. 2 and 3 are cross-sectional views of conventional intake burners.
Figure 3:
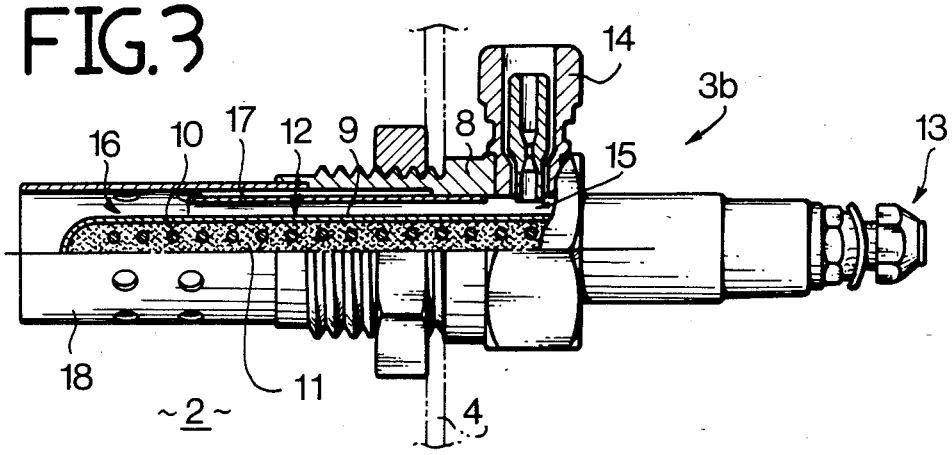
Figure 4:
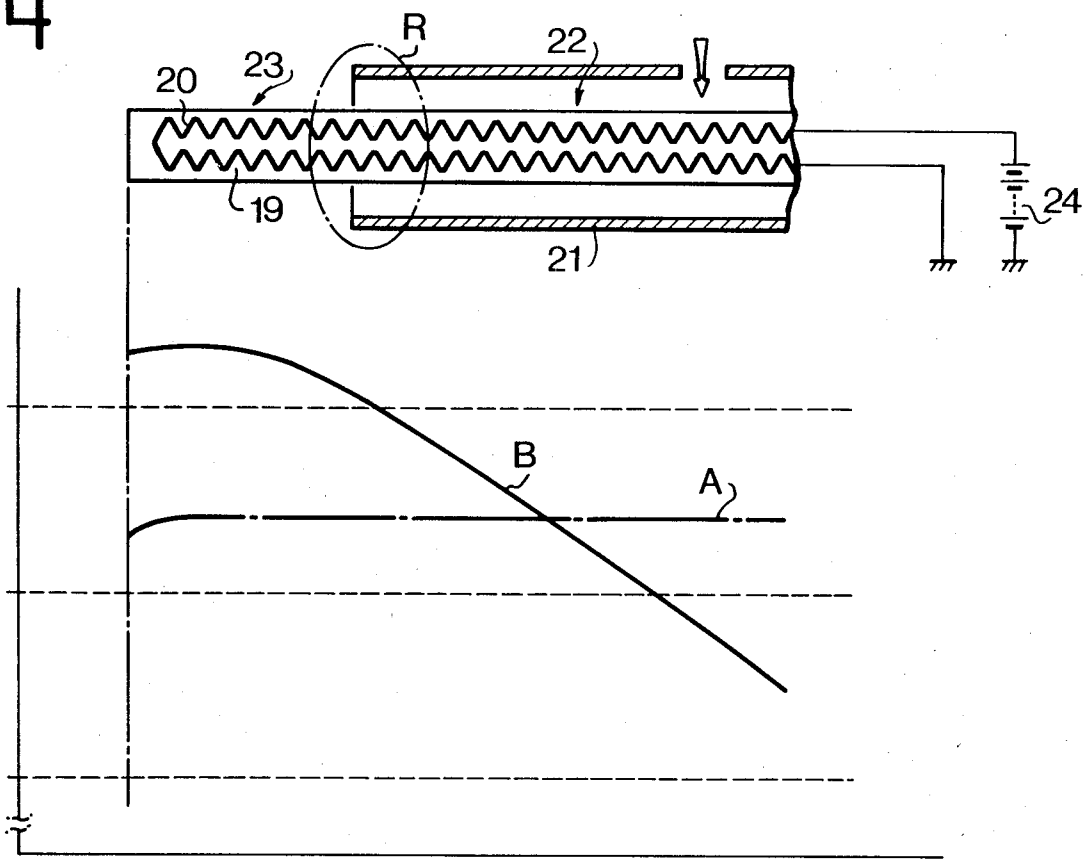
FIG. 4 is a cross-sectional view of a heater construction with a heating resistor of an equal pitch coil embedded therein based on the principles of the present invention, along with a graph showing surface temperature distributions over the heater.
Figure 9:
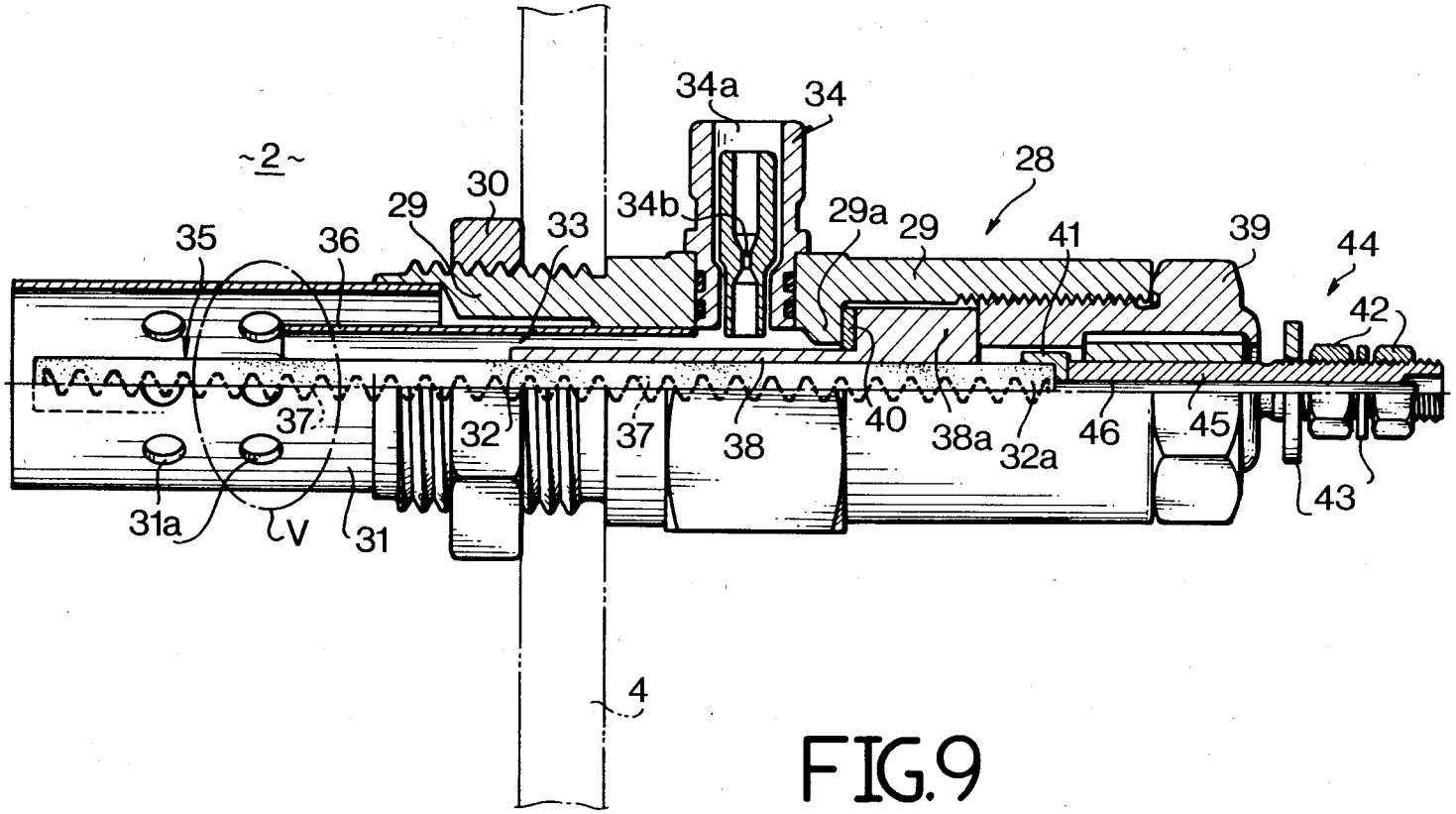
FIG. 9 is a partly cross-sectional view of an intake burner according to the present invention.

FIG. 9 illustrates an intake burner according to the principles of the present invention. The intake burner, generally designated by the reference numeral 28, is attached to and extends into an air intake tube 4 for heating intake air flowing therethrough by burning fuel therein supplied to the burner. The intake burner 28 includes a hollow outer tube 29 serving as an outer casing mounted on the air intake tube 4 by a nut 30 threaded on an end of the outer tube 29. The outer tube 29 includes a tubular protective cover 31 attached to its end and projecting into an air intake system 2.

A fuel feed nozzle 34 is mounted on a substantially central portion of the outer tube 29 and communicates with a vaporizing region 33 around a heater 32, the fuel feed nozzle 34 serving to feed fuel into the vaporizing region 33. The fuel feed nozzle 34 has a fuel inlet 34*a* positioned radially outwardly from the outer tube 29 and supplied with fuel, as from a fuel pump (not shown), for example. The fuel supplied through the fuel inlet 34*a* is metered by an orifice 34*b*, disposed inwardly of the fuel inlet 34*a* and then fed into the vaporizing region 33 around the heater 32.

The protective cover 31 is formed with air holes 31*a* for preventing flames from being blown out in a combustion region 35 disposed around the heater 32 and introducing a portion of intake air for allowing the vaporized fuel to be burned.

The heater 32 is disposed within the outer tube 29 and the protective cover 31 joined therewith. The heater 32 is in the form of a rod extending longitudinally within the intake burner 28 and disposed in and out of the air intake system 2. The heater 32 together with a holder 36 defines the vaporizing region 33 communicating with the fuel feed nozzle 34 for heating supplied fuel to vaporize the latter along the surface of the heater 32.

The combustion region 35 is located extending around the heater 32 and within the protective cover 31 and the adjacent end of holder 36, in which the vaporized fuel from the vaporizing region 33 is burned by bringing the vaporized fuel into contact with intake air.

The heater 32 is formed of a unitary mass of ceramic material formed into a self-supporting rod by a hot press. A heating resistor 37 in the form of a undulated length of tungsten wire, of a diameter within the range from 0.1 to 0.5 mm embedded in the heater 32. The ceramic material comprises silicon nitride ($Si_3N_4$) that is highly resistant to thermal impact so that the heater 32 may be brought to a high temperature to effect sustained and stable fuel combustion. The ceramic material surrounding the tungsten heating resistor 37 prevents oxidation and also allows rapid heating of the tungsten heating resistor 37 to enable increased heating speed. The tungsten has a large temperature coefficient of resistance to generate very quickly a great quantity of heat. This allows the tungsten heating resistor 37 in turn to very rapidly heat the highly heat-resistant ceramic material and produce a high surface temperature of the heater 32 almost instantaneously, for vaporizing and igniting the fuel.

The holder 36 is tubular in shape and is disposed around the heater 32, which has its outer surface exposed therein, with the inside surface of the holder 36 spaced radially outwardly therefrom, with the vaporizing region 33 and the combustion region 35 defined therebetween. The holder 36 has one end attached to the outer tube 29 for allowing the fuel supplied in the holder 36 to be filled in the space between the holder 36 and the heater 32 and also for guiding the fuel vaporized in the vaporizing region 33 longitudinally along the heater 32 into the combustion region 35 within the air intake system 2. A tubular support member 38 is mounted on a portion of the heater 32 disposed in the vaporizing region 33 outside of the air intake system 2 located opposite the fuel feed nozzle 34, so as to prevent the covered heater portion from being rapidly cooled by the supplied fuel. The support member 38 has a larger diameter end portion 38*a* pushed by a hollow bolt 39 threaded in the outer end of the outer tube 29 against an annular gasket 40 on a step 29*a* of the outer tube 29, thereby supporting the heater 32 in position.

The heater 32 has an end 32*a* projecting out of the support member 38, and an electrode 41 to which an end of the heating resistor 37 is connected is mounted on the heater end 32*a*. The electrode 41 is held against an end of a rod 45 with nuts 42 and plates 43 mounted thereon, the rod 45, the nuts 42 and the plates 43 jointly constituting a terminal 44. A lead wire 46 connected to the terminal 44 is joined to the electrode 41. A voltage is applied from a power supply (not shown) such as a battery to the electrode 41 through the terminal 44 and the lead wire 46. The heating resistor 37 has a grounding end (not shown) electrically connected to the intake tube 4 by a connection to the support member 38 and contact of the support member 38 with the outer tube 29 which are each made of metal.

Operation of the intake burner of the foregoing construction will now be described.

To start the engine, a key-operated switch is turned on to apply a voltage to the heating resistor 37 from the power supply such as a battery. At the same time, the entire heater 32 is rapidly heated by energizing the tungsten wire resistor 37, fuel is supplied through the fuel feed nozzle 34 from the fuel pump into the vaporizing region 33 around the heater 32. Fuel filling the holder 36 is vaporized in the vaporizing region 33 around the heater 32 heated by the heating resistor 37. The vaporized fuel then flows from the holder 36 to the combustion region 35 around the heater 32 outside of the holder 36. The vaporized fuel is guided out of holder 36 into contact with a portion of intake air and ignited and burned in the combustion region 35 to thereby heat the flow of air. The heated air is then drawn into the engine cylinders to enable fuel to be readily ignited and burned in the engine cylinders, so that the engine will be started quickly and run smoothly.

With the arrangement of the present invention, the heater 32 is a unitary body of ceramic material and the heating resistor 37 of tungsten wire is embedded in the heater 32. Since the tungsten wire can generate a large quantity of heat in a moment, the heater 32 as a whole is heated to a high temperature within a very short period of time. The heater 32 maintained at a high temperature ignites fuel two or three seconds after a voltage has been applied thereto. Since the ceramic material is highly resistant to heat, oxidation and corrosion, the heater 32 is durable and reliable in operation. With the heater 32 able to be kept at a high temperature while exposed to intake air, stable fuel combustion can be maintained for improved engine starting capability. Using tungsten wire of a high temperature coefficient of resistance as the heating resistor 37, embedded in the ceramic material, the heater 32 can easily be temperature controlled by selecting the level of electric current flowing therethrough and the time interval of energization thereof, which are suited to ambient temperature, rate of fuel flow, engine characteristics, and other factors.

Various embodiments based on the foregoing principles of the invention will be described in detail with reference to the drawings.

Figure 10:
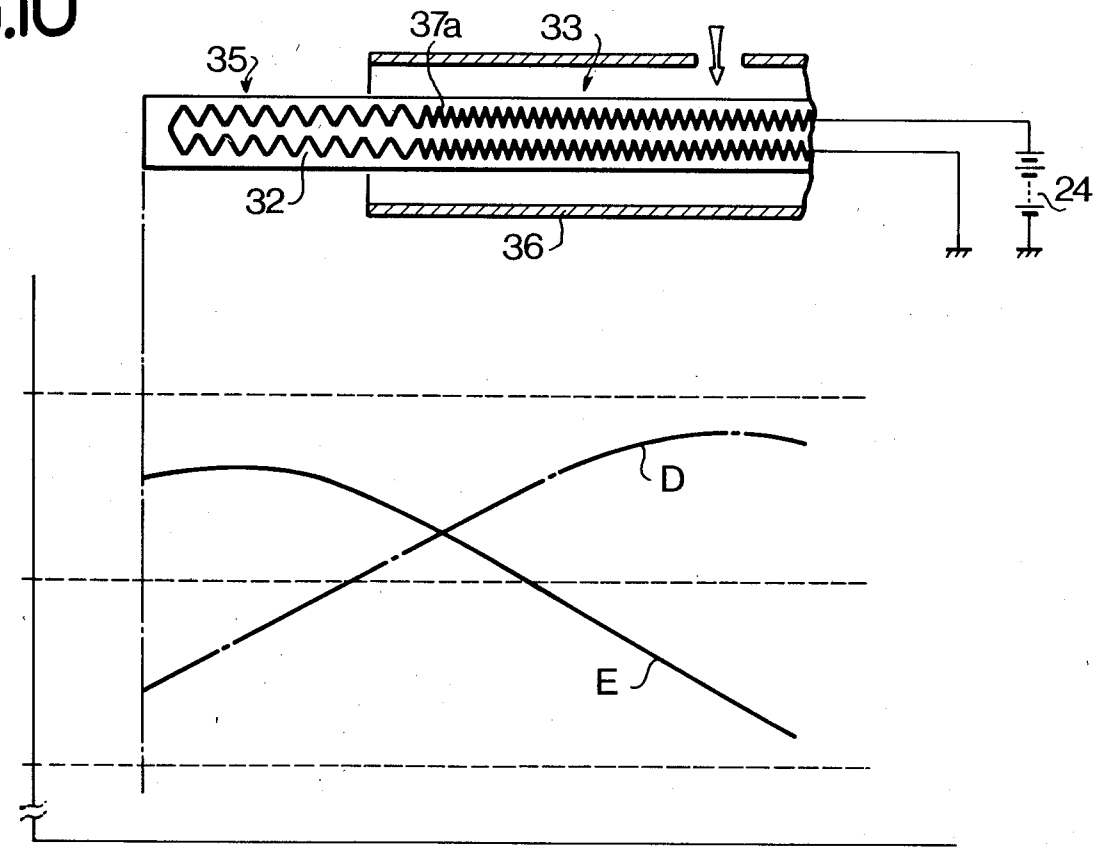
FIG. 10 is a diagram showing a heater construction with a heating resistor embedded therein according to a first embodiment, along with a graph showing surface temperature distributions over the heater.

Embodiment 1: This embodiment is shown in FIG. 10 and is designed primarily to solve the problem referred to above in item (1). According to embodiment 1, the vaporizing region 33 has a higher temperature distribution than that of the combustion region 35. As shown in FIG. 10, a heating resistor 37*a* in the form of an undulated length of tungsten wire is constructed such that the vaporizing region 33 will have a higher temperature distribution than the combustion region 35. More specifically, the undulations of the heating resistor 37*a* is arranged to have a varying pitch with a closer pitch in the vaporizing region 33 than the undulations of the heating resistor 37*a* in the combustion region 35. With this arrangement, more heat is generated by the heater 32 in the vaporizing region 33. This can prevent the heating resistor 37*a* from undergoing an excessive partial voltage drop in the vaporizing region 33 due to a temperature reduction caused by supplied fuel to prevent the heater 32 from being excessively heated in the combustion region 35.

As also shown in FIG. 10, the surface temperature T of the heater 32 does not exceed the allowable maximum temperature Tmax for the ceramic material during the time prior to a substantial flow of fuel, at which time the vaporizing region 33 is heated to a degree greater than the heating of the combustion region 35 (as shown by the dot-and-dash line D). As the quantity of fuel flow increases, the temperature of the combustion region 35 is increased, while the temperature drops in the vaporizing region 33, but this decrease in temperature is of a lesser degree than in the designs referred to above. The temperature of the surface of the heater 32 in the combustion region 35 is held below the allowable maximum temperature Tmax for the ceramic material, but above the ignition temperature $T_F$ for the vaporized fuel. At the same time, the temperature of the vaporizing region 33 is kept higher than the mimimum temperature $T_L$ sufficient for vaporizing the fuel (as shown by the solid line E).

The heater 32 employed in the intake burner of the present invention is capable of easily establishing an electrical resistance distribution and thereby a heater temperature distribution for proper temperature control of the heater 32, since the heating resistor 37 comprises a tungsten wire. Based on this, the heating resistor 37*a* is arranged to provide a higher temperature distribution in the vaporizing region 33 than in the combustion region 35 to thereby keep the actual temperature distributions over the vaporizing region 33 and the combustion region 35 in balance. The heater 32 itself is also more reliable structurally, so as to function more efficiently.

Also, the heater 32 within the combustion region 35 is able to produce a sufficient amount of heat even though it is exposed to flowing air.

In the above embodiment 1, the heating resistor 37*a* has undulations of varying pitch for selecting temperature distributions. However, the heating resistor 37*a* is not limited to this structure, but may have sections having a different wire diameter of other varying parameters.

Embodiment 2: As with embodiment 1, embodiment 2 shown in FIG. 11 is designed to eliminate the problem referred to above in item (1).

Figure 11:
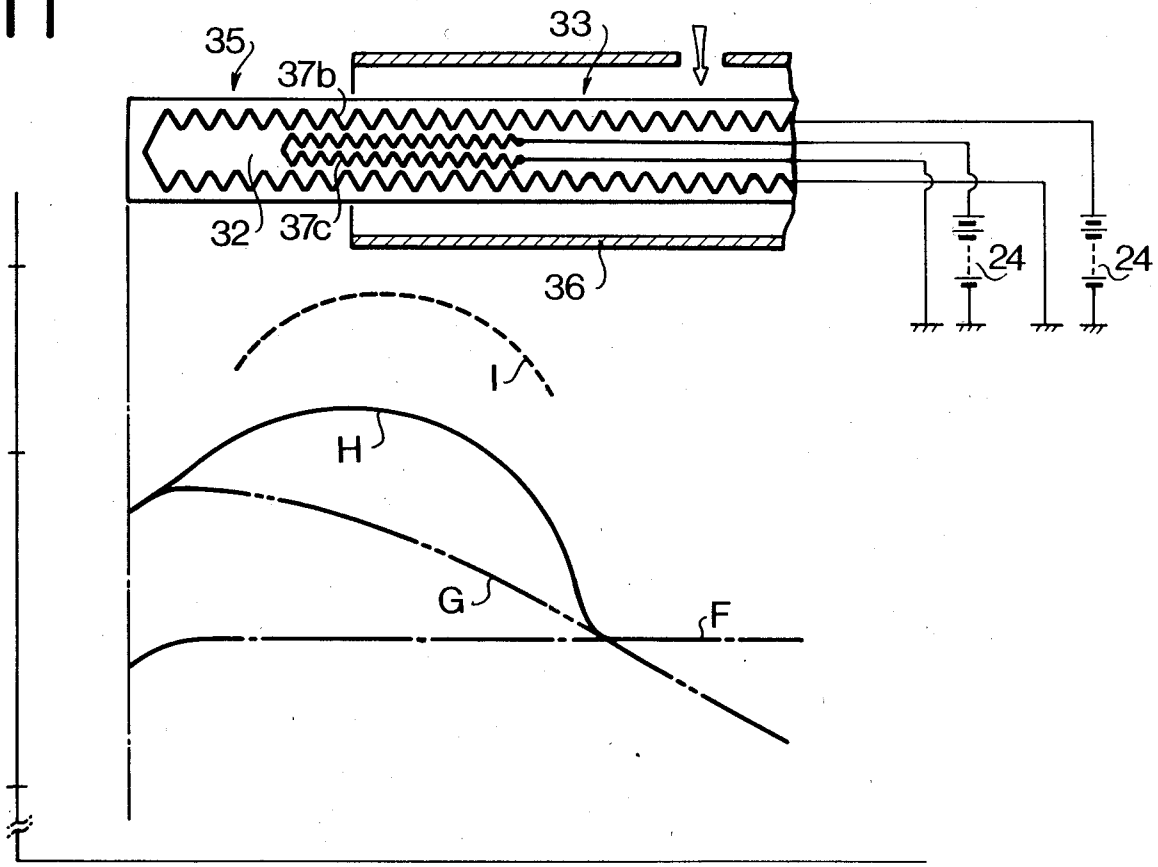
FIG. 11 is a diagram showing a heater construction with first and second heating resistors embedded therein according to a second embodiment, along with a graph showing surface temperature distributions over the heater.

As shown in FIG. 11, the heater 32 has a first heating resistor 37*b* heated to a minimum extent sufficient for heating the overall surface of the heater 32 to higher than the minimum temperature $T_L$ for vaporizing fuel, and a second heating resistor 37*c* for independently heating the surface of the heater 32 in a boundary region between the combustion and vaporizing regions 35, 33 above the lowest ignition temperature $T_F$. This thereby promotes the ignition of the vaporized fuel in cooperation with the heating of the first heating resistor 37*b*.

With embodiment 2, the ceramic material contains therein the first and second heating resistors 37*b*, 37*c*, and the first heating resistor 37*b* extends substantially the entire length of the heater 32 in the longitudinal direction and spaced from the central core of the heater 32, and the second heating resistor 37*c* extends in the central core of the heater 32 across the boundary region in superimposed relation to the first heating resistor 37*b*. The first and second heating resistors 37*b*, 37*c* are grounded to the air intake tube 4 as indicated schematically in FIG. 11, and voltages from power supplies 24 such as batteries are applied respectively to the first and second heating resistors 37*b*, 37*c* through the terminal 44. The first heating resistor 37*b* is heated during the entire period of time for starting the engine, while the second heating resistor 37*c* is heated only when the vaporized fuel is to be ignited.

With this arrangement, the amount of heat necessary for fuel ignition can be supplied from the second heating resistor 37*c* even when the temperature distribution over the entire surface of the heater 32 is equalized to the lowest temperature $T_L$ for fuel vaporization to suppress the excessive heating of the combustion region 35. This enables the heater 32 to be heated sufficiently for the vaporized fuel to be ignited, even with the combustion region 35 exposed to the low temperature intake air.

As illustrated in FIG. 11, the surface temperature T of the heater 32 is selected to be higher than the lower temperature $T_L$ (as shown by the dot-and-dash line F) for enabling the heater to vaporize the fuel, with the temperature of the combustion region 35 lower than the ignition temperature $T_F$, by applying a relatively low voltage to the first heating resistor 37*b* before the fuel is supplied. Thereafter, the temperature of the combustion region 35 is increased (as shown by the two dot-and-dash line G) as the fuel is progressively supplied into the vaporizing region 33. By applying a relatively high voltage to the second heating resistor 37*c*, the surface temperature T of the heater 32 between the boundary region and the combustion region 35 is kept below the allowable temperature Tmax for the ceramic material and above the ignition temperature $T_F$ for the vaporized fuel. At the same time, the vaporizing region 33 is maintained at higher than the minimum temperature $T_L$ (as shown in the solid line H) for vaporizing the fuel. While the second heating resistor 37*c* in the heater 32 is cooled by the vaporized fuel on the heater surface as shown by the dotted line I, the second heating resistor 37*c* can produce a large quantity of heat to increase the temperature of the heater 32 so that its ignition capability will not be impaired.

Operation of the intake burner according to embodiment 2 will be described. When the key-operated switch is turned on, a relatively low voltage is first applied to the first heating resistor 37*b* from the power supply 24 such as a battery. As the entire heater 32 is rapidly heated by the first heating resistor 37*b* as shown by the dot-and-dash line F in FIG. 11, fuel is supplied from the fuel pump through the fuel feed nozzle 34 into the vaporizing region 33 around the heater 32.

Then, a relatively high voltage is independently applied to the second heating resistor 37*c*. The first heating resistor 37*b* keeps the entire heater 32 at higher than the lowest temperature $T_L$ sufficient for vaporizing the supplied fuel before and after the fuel is supplied, for thereby vaporizing the fuel progressively supplied and filled in the holder 36 throughout the whole period of starting the engine. The vaporized fuel is guided to flow from the holder 36 into the combustion region 35 around the heater 32. The boundary region is heated by the first heating resistor 37*b* as well as by the second heating resistor 37*c* up to a temperature between the allowable temperature Tmax for the ceramic material and the ignition temperature $T_F$, as shown by the solid line H. This thereby causes igniting and burning of the vaporized fuel flowing out of the holder 36 and into contact with a portion of the intake air within the combustion region 35, to thereby heat the intake air. Once flames are produced in the combustion region 35, the second heating resistor 37*c* is de-energized, and the fuel can be continuously burned by allowing the vaporized fuel to be ignited by the produced flames.

With the second embodiment 2, as described above, the temperature distribution of the heater 32 can be established more easily and reliably. By providing separate first heating resistor 37*b* and second heating resistor 37*c* for heating the boundary region between the combustion region 35 and the vaporizing region 33 around the heater 32 to thereby ignite the vaporized fuel, the voltage applied is held to a minimum and the heater 32 can be heated as a whole with a prescribed heater distribution with minimum use of energy. The heater 32 can thus be sufficiently temperature controlled and is of a more reliable construction.

As with the first heating resistor 37*b*, the voltage may alternatively be impressed on the second heating resistor 37*c* throughout the entire time interval of operation of the intake burner.

While in the arrangement of FIG. 9 and the embodiments 1 and 2, the heating resistors comprise tungsten wires, the heating resistors may comprise wires of molybdenum.

A switch (not shown) may be inserted between the second heating resistor 37*c* and its power supply, and a temperature sensor (not shown) for detecting the temperature of the boundary region may be provided to control the switch so that the voltage will be imposed on the second heating resistor when the temperature of the boundary region is dropped below the ignition temperature $T_F$.

Figure 12:
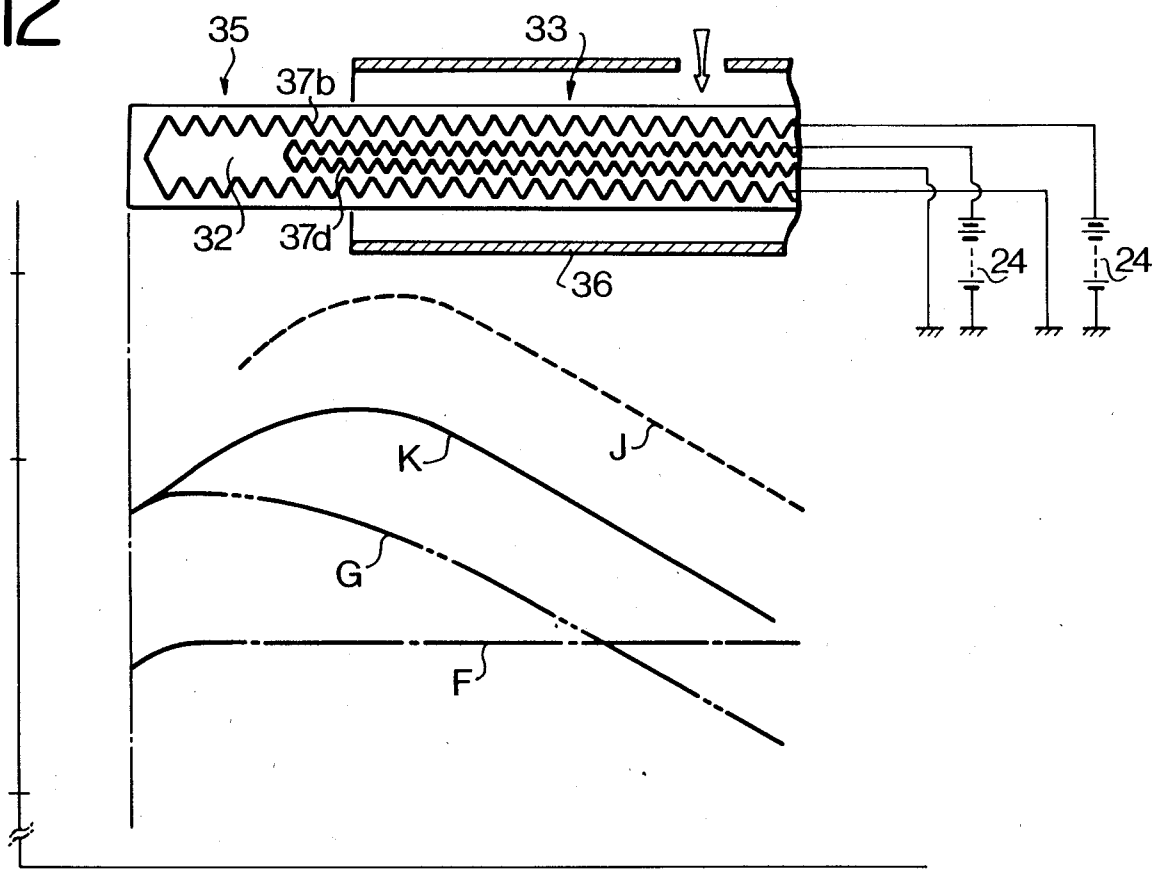
FIG. 12 is a diagram of a heater construction according to a modification of the second embodiment, along with a graph showing surface temperature distributions over the heater.

As illustrated in FIG. 12, the second heating resistor 37*d* may be extended into the vaporizing region 33. With this modification, the vaporizing region 33 as well as the combustion region 35 is heated (as shown by the solid line K in FIG. 12) by energizing the second heating resistor 37*d*. The heating produced without fuel flow is shown by the dotted line J. This additional heating in the vaporizing region 33 produces more efficient fuel vaporization which contributes to fuel combustion.

Embodiment 3: The embodiment 3 is calculated to solve the problem referred to above in item (1), similarly to embodiments 1 and 2.

Figure 13:
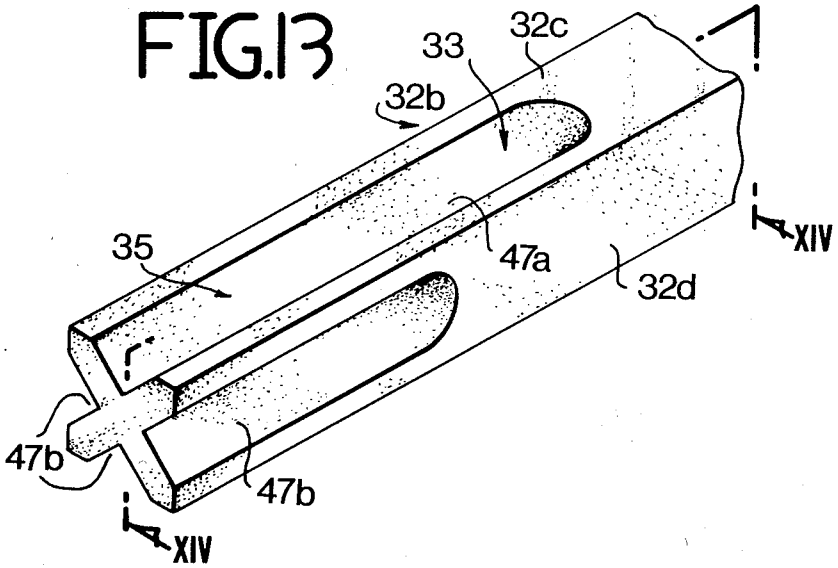
FIG. 13 is a perspective view of a heater according to a third embodiment.
Figure 14:
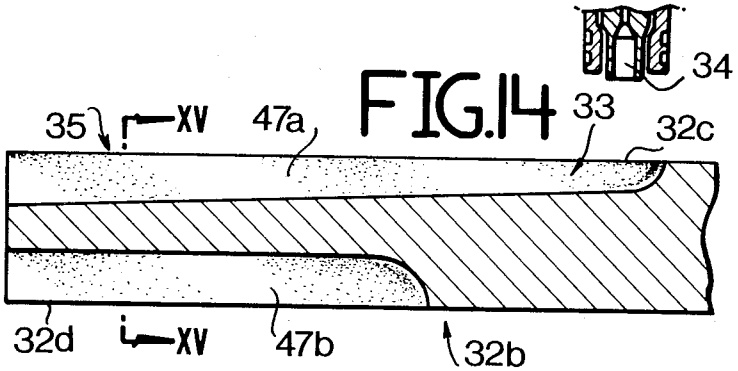
FIG. 14 is a cross-sectional view taken along line XIV—XIV of FIG. 13.
Figure 15:
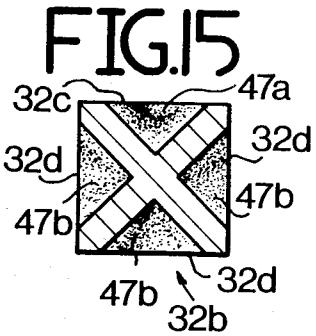
FIG. 15 is a cross-sectional view taken along line XV—XV of FIG. 14.

As shown in FIGS. 13, 14 and 15, a heater 32*b* has grooves 47*a*, 47*b* extending longitudinally thereof and progressively deeper from the vaporizing region 33 to the combustion region 35 so that the heater 32*b* has a lesser thermal capacity in the combustion region 35 than in the vaporizing region 33 and a greater heat radiation surface area in the combustion region 35 than in the vaporizing region 33. The heater 32*b* of embodiment 3 is designed to utilize the outer profile thereof in establishing a desired temperature distribution.

Figure 16:
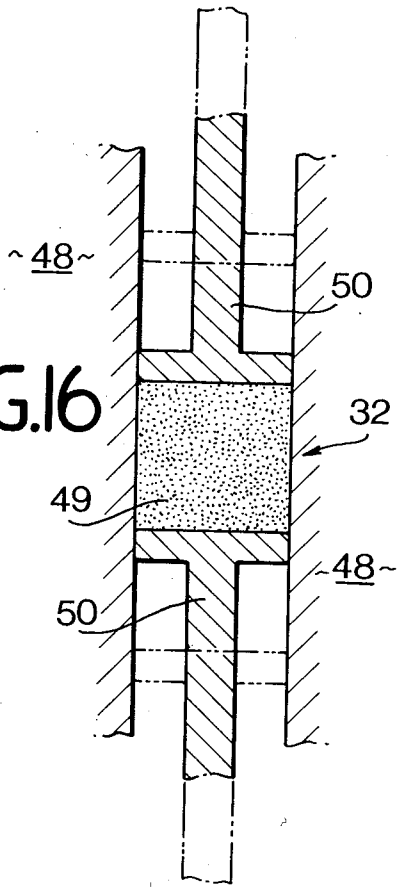
FIG. 16 is a cross-sectional view showing the manner in which a heater is formed of a ceramic material according to the present invention.

A method of manufacturing the heater of ceramic material is illustrated in FIG. 16. Molding partitions 48 are spaced from each other, and a volume of ceramic powder 49 is disposed filling the space therebetween. The volume of ceramic powder 49 is molded into the heater 32 in a hot press process by molding presses 50 disposed between the molding partitions 48, with the molding presses 50 moved toward each other.

The heater 32 thus molded is in the form of a rod having a rectangular, preferably square, cross section. However, the heater 32 may have a desired shape by mounting molds of desired shapes on the sides of the molding presses 50 or the molding partitions 48 which face the volume of ceramic powder 49.

In the illustrated embodiment 3, the heater 32*b* is of a rectangular (square) cross section having four sides 32*c*, 32*d*. The side 32*c* facing the fuel feed nozzle 34 has the groove 47*a* extending from a position directly below the fuel feed nozzle 34 to the combustion region 35, and the other three sides 32*d* have the grooves 47*b* positioned in the combustion region 35 only so that the thermal capacity of the vaporizing region 33 will not be reduced. The grooves 47*a*, 47*b* are vee-shaped in cross section so that the heater 32*b* has an X-shaped or radially notched cross section in the combustion region 35. This makes the thermal capacity smaller in the combustion region 35 than in the vaporizing region 33, and the heater 32*b* in effect has fins to better the heat radiation capacity in the combustion region 35.

With this embodiment, the combustion region 35 is capable of radiating much heat and has a reduced thermal capacity. Thus, even when the heater 32*b* is cooled by the supplied fuel in the vaporizing region 33 to increase heating of the heater 32*b* in the combustion region 35, this section of the heater 32*b* radiates heat highly efficiently and will not be heated excessively. Thus, the heater 32*b* resists overheating and will not be cracked due to excessive heating. Since the better heat radiation ability of combustion region 35 is characterized by a lesser increase in its electrical resistance, it can prevent a partial voltage drop in the heater in the vaporizing region 33 when it is cooled and hence can reduce the tendency towards a reduced level of heating in the vaporizing region 33.

Figure 17:
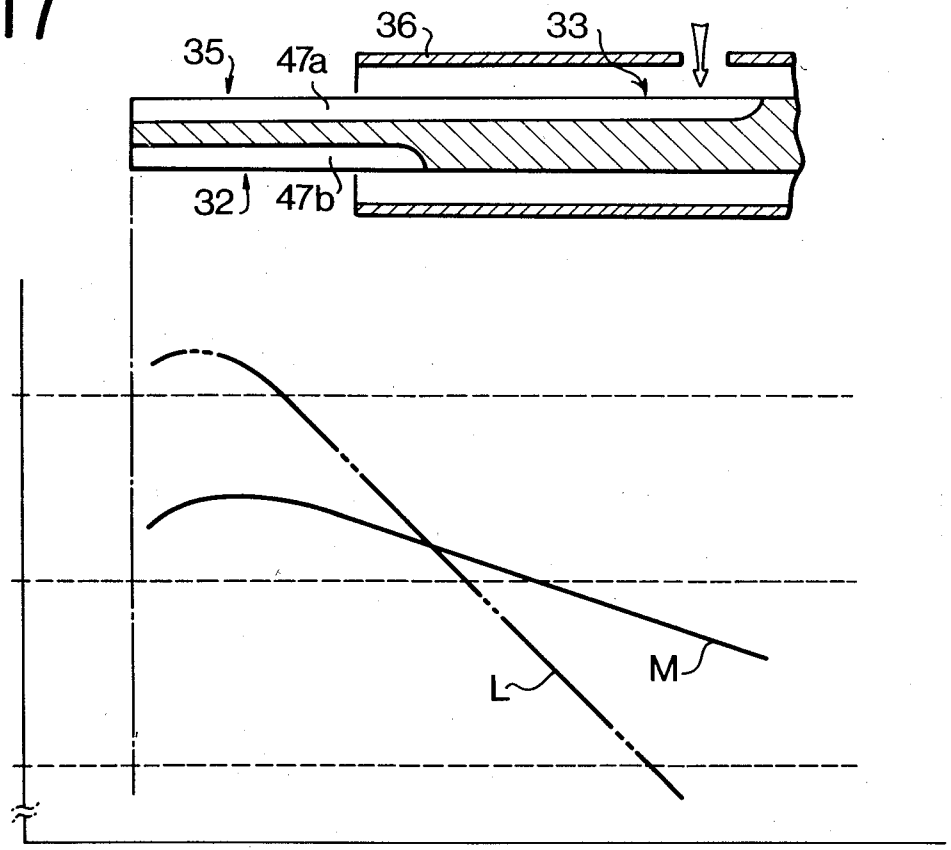
FIG. 17 is a cross-sectional view of a heater construction according to a third embodiment, along with a graph showing surface temperature distributions over the heater.

More specifically, as shown in FIG. 17, the gradient of the surface temperature T of the heater 32*b* from the combustion region 35 to the vaporizing region 33 would be as shown by the two dot-and-dash line L during the time fuel is supplied. However, by selecting the appropriate outer profile of the heater 32*b*, the combustion region 35 exposed to relatively low temperature air is given a heat radiation ability and the vaporizing region 33 is provided with a suitable heating capability and a heat retention capability, thereby reducing the temperature gradient as shown by the solid line M. The combustion region 35 is kept in a fuel ignition temperature range ($T_F$ to Tmax) and the vaporizing region 33 is kept in a fuel vaporization temperature range ($T_L$ to $T_F$) so that the heater 32*b* will have an appropriate temperature distribution as a whole without excessively heated or cooled portions. As a result, fuel can be kept vaporized in the vaporizing region 33 and ignited in the combustion region 35 for improved engine starting capability.

With this embodiment, fuel initially supplied by the groove 47*a*, opening toward the fuel feed nozzle 34 and prior to being filled in the holder 36 is received by the heater 32*b* and allowed to flow thereon so as to be efficiently vaporized between the vaporizing region 33 and the combustion region 35. Therefore, fuel ignition can be improved in the combustion region 35 and the intake air can be heated by stable fuel combustion with the flames protected from being blown out.

Embodiment 4: Embodiment 4 is designed to avoid the problem referred to above in item (2).

Figure 19:
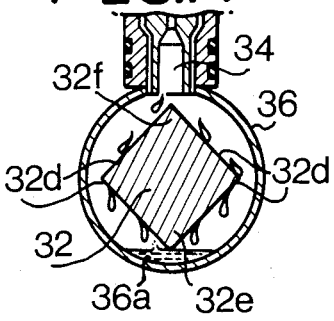
FIG. 19 is a cross-sectional view taken along line XIX—XIX of FIG. 18.
Figure 18:
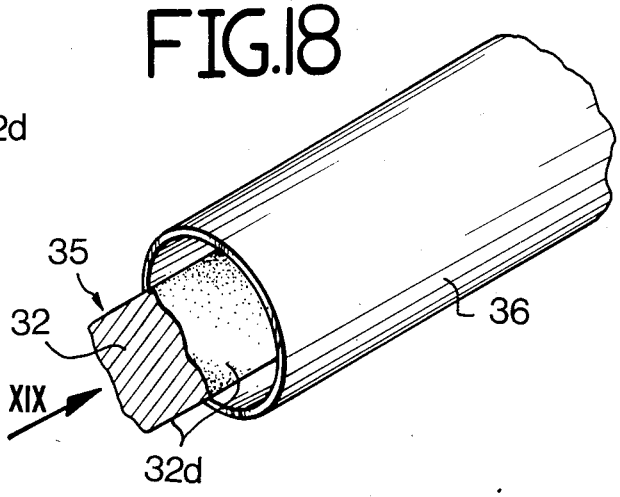
FIG. 18 is a perspective view of a heater portion encircled with V in FIG. 9, showing a heater and holder combination according to a fourth embodiment.

As illustrated in FIGS. 18 and 19, an intake burner comprises a heater 32 having a substantially rectangular, i.e., square, cross section and is heated by a heating resistor (not shown) for heating, vaporizing and burning supplied fuel as it flows longitudinally down the outer surface of the heater 32. A holder 36 of a tubular configuration surrounds the heater 32, for promoting vaporization of fuel filled between the heater 32 and the holder 36, as before. With this arrangement, the intake burner is capable of promoting fuel vaporization during an initial fuel supply period for improved fuel ignition.

According to this embodiment, the heater 32 is of a substantially square cross section, which is manufactured by the process described above, and is positioned in a rotated position in the holder 36 from the previously described embodiments, and extends longitudinally from the vaporizing region 33 to the combustion region 35. The heater 32 has a corner 32*e* located adjacent to an inner bottom wall 36*a* of the holder 36. More specifically, fuel supplied from the fuel feed nozzle 34 is divided laterally by a corner 32*f* of the heater 32 facing the fuel feed nozzle 34 as shown in FIG. 19 and flows down two opposite sides 32*d*. Even when the fuel going down the sides 32*d* is not vaporized, it drips on the inner bottom wall 36*a* of the holder 36 where the fuel forms a pool in contact with the corner 32*e* of the heater 32.

With this construction, fuel initially fed from the fuel feed nozzle 34 is brought into contact with the entire outer surface of the heater 32 including the four sides 32*d* for efficient fuel vaporization. Any fuel that has reached the inner bottom wall 36*a* of the holder 36 can be heated and turned into vapor by the substantially horizontal corner 32*e* over its length extending from the vaporizing region 33 to the combustion region 35, and is thereby prevented from flowing out into the air intake system 2. Consequently, the intake burner can ignite the fuel instantaneously and reliably.

This intake burner does not involve any increase in cost since the heater 32 is only tilted with respect to the holder 36.

Embodiment 5: As with embodiment 4, embodiment 5 is arranged to eliminate the difficulty mentioned above in item (2).

Figure 20:
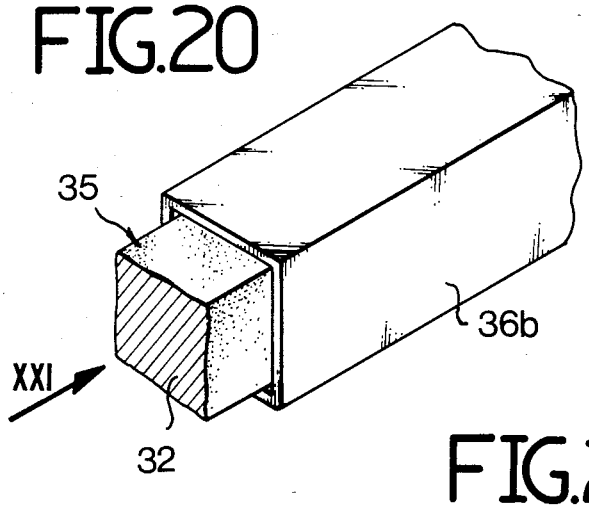
FIG. 20 is a perspective view of a heater portion encircled with V in FIG. 9, showing a heater and holder combination according to a fifth embodiment.
Figure 21:
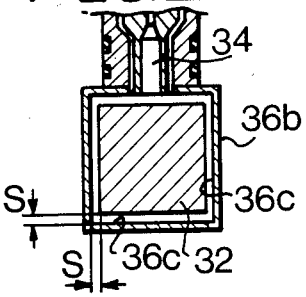
FIG. 21 is a cross-sectional view taken along line XXI—XXI of FIG. 20.

As shown in FIGS. 20 and 21, an intake burner of embodiment 5 is composed of a heater 32 and a holder 36*b* in combination.

The holder 36 which surrounds the heater 32 is of a tubular shape having at least its inner peripheral surface 36*c* spaced substantially equally from the outer peripheral surface of the heater 32. In the illustrated embodiment, the holder 36*b* is complementary in shape to the heater 32, and in surrounding relation thereto.

According to experimental studies conducted by the inventors, it is most preferable that the outer peripheral surface of the heater 32 and the inner peripheral surface 36*c* of the holder 36*b* be spaced a distance S in the range of from 0.2 to 2.0 mm in view of the speed of supply and viscosity of supplied fuel, the thickness of a fuel film formed on the outer peripheral surface of the heater 32, the longitudinal temperature distribution on the heater 32, and other factors.

By assembling the complementary holder 36*b* around the heater 32 of substantially square or rectangular cross section with the spacing S provided substantially equally therebetween, the heater 32 of the embodiment 5 can provide the same advantage as that achieved by embodiment 4.

Figure 22:
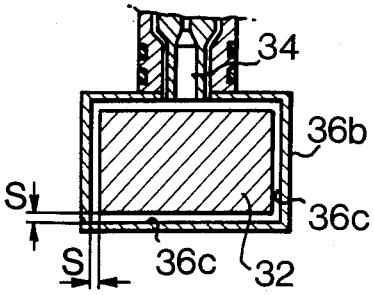
FIG. 22 is a cross-sectional view of a heater having a rectangular cross section.

FIG. 22 illustrates an intake burner having a heater 32 having a rectangular, non-square cross section.

Embodiments 6, 7 and 8: Similarly to embodiments 4 and 5, embodiments 6, 7 and 8 are designed to eliminate the shortcoming referred to above in item (2).

As shown in FIGS. 23–25 and 23A–25A, each intake burner has a heater 32 to which fuel is supplied from the fuel feed nozzle 34, the heater 32 being constructed in outer profile to promote vaporization of fuel supplied in an initial period for improved fuel ignition.

According to these embodiments, the heaters have guide grooves 48*a*, 48*b*, 48*c* extending from the vaporizing region 33 in which the fuel feed nozzle 34 faces to the combustion region 35, the guide grooves 48*a*, 48*b*, 48*c* forming part of the surface of the heater 32 and being receptive of an initial flow of fuel fed from the fuel feed nozzle 34 for guiding the fuel therein while at the same time allowing the fuel to be progressively vaporized for ignition in the combustion region.

Figure 23A:
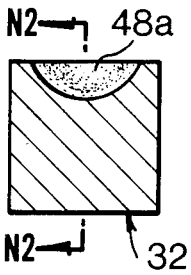
FIG. 23A is a cross-sectional view taken along line N1—N1 of FIG. 23.
Figure 23:
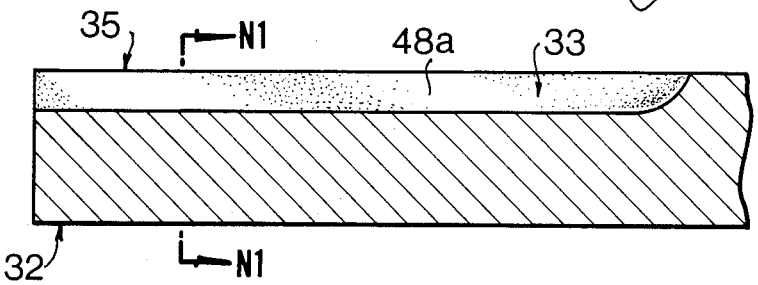
FIG. 23 is a cross-sectional view of a heater construction according to a sixth embodiment, the view being taken along line N2—N2 of FIG. 23A.

FIG. 23 shows the heater 32 according to embodiment 6, the heater 32 being of a simplified construction. The groove 48*a* is of an arcuate cross section extending from the vaporizing region 33 in which the fuel feed nozzle 34 faces to the combustion region 35. The guide groove 48*a* is progressively shallower toward the rear end in the vaporizing region 33 for enabling the supplied fuel to flow toward the combustion region 35.

With such an arrangement, the guide groove 48*a* guides the supplied fuel onto the heater 32 and enables the fuel to be efficiently vaporized between the vaporizing region 33 and the combustion region 35 so that the fuel can be ignited easily in the combustion region 35.

Figure 24A:
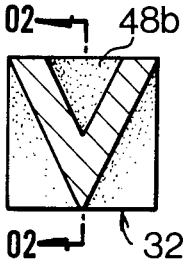
FIG. 24A is a cross-sectional view taken along line 01—01 of FIG. 24.
Figure 24:
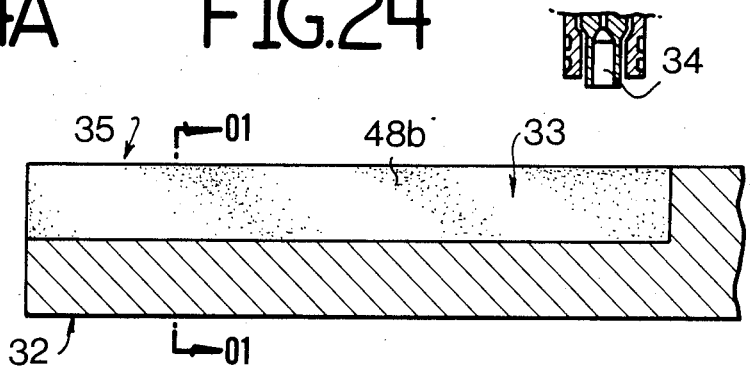
FIG. 24 is a cross-sectional view of a heater construction according to a seventh embodiment, the view being taken along line 02—02 of FIG. 24A.

FIG. 24 illustrates embodiment 7 in which the guide groove 48*b* extends from the vaporizing region 33 to the combustion region 35, and is of a vee-shaped cross section. The heater of FIG. 24 has the same advantage as that of the heater shown in FIG. 23.

Figure 25A:
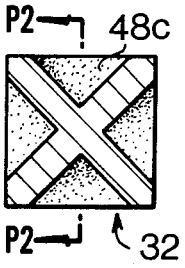
FIG. 25A is a cross-sectional view taken along line P1—P1 of FIG. 25.
Figure 25:
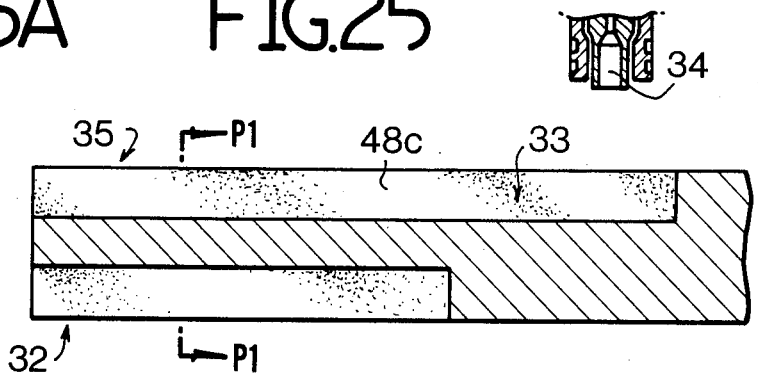
FIG. 25 is a cross-sectional view of a heater construction according to an eighth embodiment, the view being taken along line P2—P2 of FIG. 25A.

FIG. 25 shows the embodiment 8 in which the heater 32 is constructed in an X-shaped or radially notched cross section to thereby form the guide grooves 48*c*. The heater shown in FIG. 25 also has the same advantage as that of the heaters of FIGS. 23 and 24.

With embodiment 8, the cross-sectional area of the heater 32 is greater in the vaporizing region 33 than in the combustion region 25 to provide a larger thermal capacity in the vaporizing region 33 than in the combustion region 35. The heater 32 has a plurality of fins to better heat radiation at the end in the combustion region 35. This heater also has the same advantage as that of embodiment 3.

Embodiment 9: Embodiment 9 is calculated to solve the problem referred to above in item (3).

Figure 28:
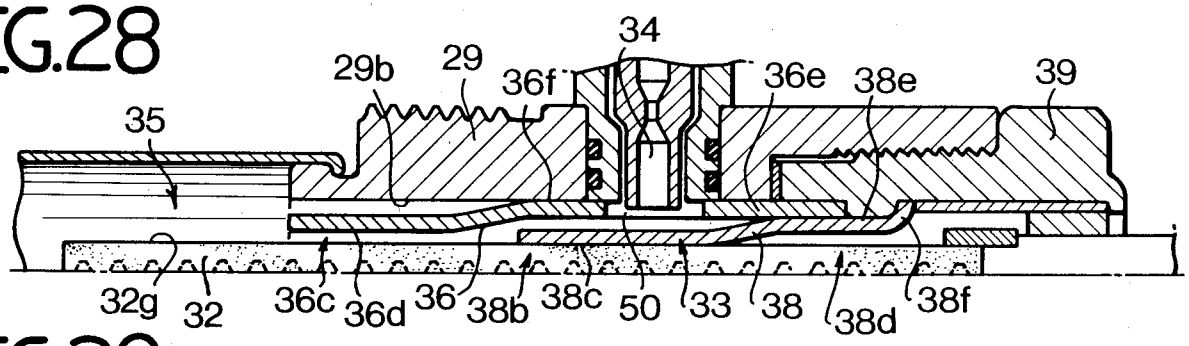
FIG. 28 is a fragmentary cross-sectional view of an intake burner according to the ninth embodiment.

As shown in FIGS. 26 and 27, an intake burner is composed of a support member 38 for attaching a heater 32 to the outer tube 29 and a holder 36 for promoting vaporization of fuel as it flows. The support member 38 and the holder 36 are formed by processing thin cylindrical pipes in a cold working process such as pressing. More specifically, as shown in FIGS. 26 and 28, the support member 38 has its outer and inner peripheral shapes similar to each other and its circular cross section gradually blending into a square cross section. The support member 38 has one end 38*b* formed by the cold working process into a square cross section, the end 38*b* having an inner peripheral surface 38*c* surrounding an end portion of the heater 32 to prevent the vaporizing region 33 from being excessively cooled by fuel supplied from the fuel feed nozzle 34. The other end 38*d* of circular cross section which is not pressed will be fitted in an inner peripheral surface 29*b* of the outer tube 29. The end 38*d* has a radially outward flange 38*f* pushed by the bolt 39 into engagement with the outer tube 29 for thereby retaining the heater 32 in position.

As illustrated in FIGS. 27 and 28, the holder 36 is formed in substantially the same manner as that of the support member 38. The holder 36 has an end 36*c* formed by a cold working process into a square cross section and having an inner peripheral surface 36*d* shaped to cover an outer peripheral surface 32*g* of the heater 32 with an equal space therebetween from the vaporizing region 33 to the combustion region 35. The other end 36*e* of circular cross section which is not pressed has an outer peripheral surface 36*f* fitted in the inner peripheral surface 29*b* of the outer tube 29.

FIG. 28 shows these components assembled together. According to this embodiment, the circular end 36*e* of the holder 36 extends sufficiently toward the support member 38 and is sandwiched in position between an outer cylindrical surface 38*e* of the support member 38 and the inner peripheral surface 29*b* of the outer tube 29. The circular end 36*e* of the holder 36 has a fuel inlet 50 aligned with the square end 38*b* of the support member 38 which has the heater 32 fitted therein in the vaporizing region 33 to face the fuel feed nozzle 34.

The holder 36 and the support member 38 are therefore constructed by processing thin cylindrical pipes with a cold working process such as pressing, and only those portions of square cross section are pressed or otherwise formed. These components can more easily be manufactured than conventional components at a high rate of production. Therefore, by utilizing these structural configurations, intake burners can be mass-produced.

The heater 32 and the outer tube 29 require no design change at all, and hence can be employed without altering their manufacturing processes.

Figure 29:
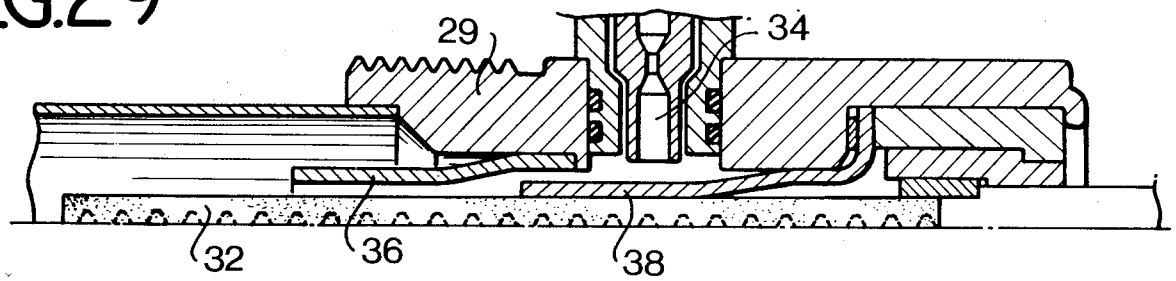
FIGS. 29 and 30 are fragmentary cross-sectional views of intake burners according to modifications of the ninth embodiment.

FIG. 29 shows a holder mounted in an intake burner, the holder being provided by cutting off the holder 36 shown in FIG. 27 along the two dot-and-dash line. This holder structure can cut down on the cost of material and dispense with the process of forming the fuel inlet. Thus, the holder can be fabricated at a much higher rate of production.

Figure 30:
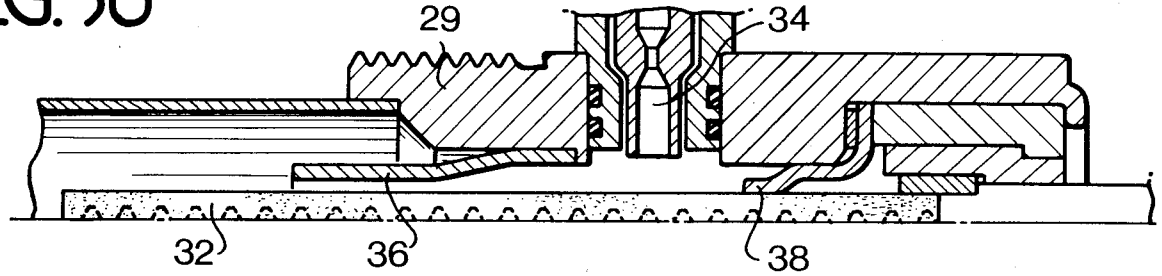

While in the foregoing embodiment the support member 38 is attached in covering relation to the heater 32 to prevent the latter from being excessively cooled by the supplied fuel in the vaporizing region 33, the support member 38 may not cover the heater 32 in the vaporizing region 33 as shown in FIG. 30, where the thermal capacity and the temperature distribution of the heater 32 are high in the vaporizing region 33.

The arrangement of embodiment 9 is applicable to a heater having a rectangular cross section.

While in the foregoing description the construction according to the principles of the invention and the various embodiments are described and illustrated, these embodiments can selectively be incorporated into the basic arrangement shown in FIG. 9 to provide a high performance intake burner, optimum for a particular application.

ADVANTAGES OF THE INVENTION

The present invention has the following advantages:

(1) The heater is molded of a ceramic material which is highly resistant to heat, oxidation and corrosion, with the heating resistor having a high temperature coefficient of resistance embedded therein. A relatively high voltage can be applied to the heater to heat the latter up to a high temperature. The heater itself is highly durable and reliable in operation, and capable of igniting fuel instantaneously and reliably for smoothly heating intake air flowing through the intake air system to thereby improve engine starting capability.

(2) Since the heater is composed of the ceramic body with the heating resistor embedded therein, it can freely establish a desired temperature distribution and thermal capacity. Thus, the heater can be properly controlled in temperature.

(3) Therefore, the heater can have a higher temperature distribution in the vaporizing region than in the combustion region to prevent the latter from being heated to a temperature higher than the allowable maximum temperature for the ceramic material and to heat the combustion region and the vaporizing region to desired temperatures. Accordingly, the heater can be heated to a proper temperature distribution and be of increased structural reliability in service.

(4) The first and second heating resistors can be embedded in the heater for producing desired amounts of heat. The heater can thus be heated while minimizing the consumption of power from a power supply such as a battery. With the first and second heating resistors, the heater is also reliable in construction.

(5) The heater can be of an outer profile such that its heat radiation surface area may be greater in the combustion region than in the vaporizing region. This gives the heater a heat radiation capability in the combustion region and a heat retention capability in the vaporizing region. The heater can be prevented from being excessively heated at a localized portion and be heated to an overall appropriate temperature distribution. Consequently, the heater is highly reliable in operation, and the intake burner can ignite and burn the fuel easily and is more durable in use.

(6) The heater which must be of either square or non-square rectangular cross section due to manufacturing limitations, may be rotated with respect to the cylindrical tubular holder to position a corner of the heater in the vicinity of an inner bottom wall of the holder. Any initial fuel supplied which is not filled in the holder is allowed to go down the outer peripheral surface of the heater, and any pool of fuel on the inner bottom wall of the holder can be heated and vaporized efficiently by immersion of the bottom corner of the heater. Thus, intake burner can ignite the fuel instantaneously and reliably.

(7) Fuel ignition is improved by positioning the holder in surrounding relation to the heater with the inner peripheral surface of the holder being substantially equally spaced from the outer peripheral surface of the heater.

(8) Fuel ignition is also improved by providing a guide groove in the heater for receiving and guiding the supplied fuel for efficient vaporization as the fuel flows down from the vaporizing region to the combustion region.

(9) The holder and the support member can be constructed from cylindrical pipes having portions pressed into a square or an unequal sided rectangular cross section. These components can therefore be fabricated simply at a high rate of production. Intake burners can therefore be mass-produced.

(10) Other components of the intake burner, such as for example the heater and the outer tube need no modification whatsoever.

(11) The intake burner of the invention is simple in construction and can be put to use with ease.

Although certain preferred embodiments have been shown and described, it should be understood that many changes and modifications may be made therein without departing from the scope of the appended claims.

What is claimed is:

1. In combination, an intake burner and an internal combustion engine having an air intake system having an air intake tube, said intake burner comprising:

(a) an outer tube adapted to be attached to the air intake tube;

(b) an elongated heater mounted in said outer tube, said heater comprised of an elongated ceramic rod having an outer surface, and a heating resistor embedded therein, said outer surface of said rod at one end constituting a vaporizing surface and a longitudinally spaced combustion surface at the other end;

(c) a holder extending over and surrounding said one end of said heater ceramic rod with a space therebetween, said outer surface of said one end of said ceramic rod at least partially exposed within said holder with said other end of said ceramic rod protruding out of said holder, and with said outer surface thereof exposed;

(d) fuel feed means for feeding fuel into said space between said holder and said one end of said heater ceramic rod; and (e) a support member attaching said one end of said heater to said outer tube;

(f) the spaces intermediate said holder, said one end of said heater ceramic rod, fuel feed means, and support member together defining a vaporizing region for vaporizing fuel supplied by said fuel feed means, and the region around said exposed other end of said ceramic rod defining a combustion region for burning vaporized fuel supplied from said vaporizing region.

2. The combination according to claim 1 wherein said heater has a rectangular cross section throughout a length thereof, said holder comprising a cylindrical tubular configuration extending longitudinally thereof, said heater having a corner located closely to and spaced from an inner bottom wall of said holder by a predetermined distance.

3. The combination according to claim 1 wherein said heater has a rectangular cross section throughout a length thereof, said holder surrounding said heater, with a substantially equal distance between an inner peripheral surface of said holder and an outer peripheral surface of said heater.

4. The combination according to claim 3 wherein said outer tube has a cylindrical inner peripheral surface, said holder comprising a cylindrical tube having one end of a rectangular cross section surrounding the outer peripheral surface of said heater and an opposite end of a circular cross section fitted in said cylindrical inner peripheral surface of said outer tube.

5. The combination according to claim 3 wherein said outer tube has a cylindrical inner peripheral surface, said support member comprising a cylindrical tube having one end of rectangular cross section fitted over said heater in said vaporizing region and an opposite end of a circular cross section fitted in said cylindrical inner peripheral surface of said outer tube, thereby attaching said heater to said outer tube.

6. The combination according to claim 1 wherein said heater has a higher thermal capacity in said vaporizing region than in said combustion region.

7. The combination according to claim 1 wherein said heater has a higher heat radiation capability in said combustion region than in said vaporizing region.

8. The combination according to claim 1 wherein said heater has a higher temperature distribution in said vaporizing region than in said combustion region.

9. The combination according to claim 1 wherein said heater has a greater weight in said vaporizing region than in said combustion region.

10. The combination according to claim 1 wherein said heater has a wider surface area in said combustion region than in said vaporizing region.

11. The combination according to claim 1 wherein said heater has heat radiation fins in said combustion region.

12. The combination according to claim 1 wherein said heater has a guide groove for guiding fuel from said vaporizing region to said combustion region.

13. The combination according to claim 1 wherein said heating resistor is made of tungsten wire.

14. The combination according to claim 1 wherein said heating resistor is of an undulating configuration having a pitch smaller in said vaporizing region than in said combustion region.

15. The combination according to claim 1 wherein said heating resistor has a higher resistance in said vaporizing region than in said combustion region.

16. The combination according to claim 1 wherein said heating resistor has a smaller wire diameter in said vaporizing region than in said combustion region.

17. The combination according to claim 2 wherein said distance is in the range of 0.2 to 2.0 mm.

18. The combination according to claim 3 wherein said distance is in the range of 0.2 to 2.0 mm.

19. The combination according to claim 12 wherein said guide groove is an arcuate cross section.

20. The combination according to claim 12 wherein said guide groove has a X-shaped cross section.

21. The combination according to claim 12 wherein said guide groove has a vee-shaped cross section in said combustion region.

22. The combination according to claim 12 wherein said guide groove is progressively deeper from said vaporizing region toward said combustion region.

23. The combination according to claim 11 wherein said guide groove is defined by said fins on said heater.

24. The combination according to claim 1 wherein said heating resistor comprises a first heating resistor for heating said heater as a whole and a second heating resistor for heating a boundary region between said combustion and vaporizing regions to promote ignition of the vaporized fuel, said first and second heating resistors being embedded in said heater.

25. The combination according to claim 24 wherein said first heating resistor extends substantially the entire length of said heater remotely from a central core thereof, and said second heating resistor extends across said boundary region along said central core in superimposed relation to said first heating resistor.

26. The combination according to claim 24 wherein said second heating resistor extends into said vaporizing region.

27. In combination, an intake burner and an internal combustion engine having an air intake system having an air intake tune, said intake burner comprising:

(a) an outer tube adapted to be attached to the air intake tube;

(b) an elongated heater mounted in said outer tube, said heater comprised of an elongated body of ceramic material, and a heating resistor embedded therein, and providing a vaporizing surface at one end and a longitudinally spaced combustion surface at the other end;

(c) a holder surrounding said one end of said heater with a space therebetween;

(d) fuel feed means for feeding fuel into said space between said holder and said one end of said heater; and (e) a support member attaching said one end of said heater to said outer tube;

(f) spaces between said one end of said heater, said holder, said fuel feed means, and said support member defining a vaporizing region, said other end of said heater protruding out of said holder, with the region thereover defining a combustion region for burning fuel supplied from said vaporizing region, the improvement comprising means for causing said one end of said elongated body of ceramic material to be heated to a greater extent in said vaporization region than the other end in said combustion region.

* * * * *